United States Patent [19]

Mucelli

[11] Patent Number: 4,560,030

[45] Date of Patent: Dec. 24, 1985

[54] FOLDING LADDER

[75] Inventor: Aldo Mucelli, Musile di Piave, Italy

[73] Assignee: Metarplastic S.p.A., Musile di Piave, Italy

[21] Appl. No.: 634,307

[22] Filed: Jul. 25, 1984

[30] Foreign Application Priority Data

May 4, 1984 [IT] Italy ..... 61915/84[U]

[51] Int. Cl.[4] ..... E06C 1/383

[52] U.S. Cl. ..... 182/118; 182/160; 182/161

[58] Field of Search ..... 182/159, 160, 161, 162, 182/22, 178, 118

[56] References Cited

U.S. PATENT DOCUMENTS

| | | | |
|---|---|---|---|
| 949,614 | 2/1910 | Blundell | 182/178 |
| 2,088,878 | 8/1937 | Stogner | 182/162 |
| 2,981,364 | 4/1961 | Webber | 182/159 |
| 3,084,760 | 4/1963 | Lamberti | 182/160 |
| 3,901,354 | 8/1975 | Grebausky | 182/172 |
| 4,030,565 | 6/1977 | Chaput | 182/151 |

*Primary Examiner*—Reinaldo P. Machado

*Attorney, Agent, or Firm*—Kimmel, Crowell & Weaver

[57] ABSTRACT

A folding ladder comprising two pairs of uprights hinged at their top and a plurality of rungs connected to said uprights, in which each rung is formed from two equal portions hinged together and is connected to the other rungs at said point of mutual hinging by a rod parallel to the uprights. Moreover the rungs are hinged at their ends to said uprights for passing from the working configuration of the ladder in which they are orthogonal to the uprights, to the folded configuration of the ladder in which they are substantially parallel to the uprights.

4 Claims, 3 Drawing Figures

FOLDING LADDER

BACKGROUND OF THE INVENTION

This invention relates to a folding ladder.

Folding ladders are known consisting essentially of two pairs of wooden or metal uprights hinged at their top, and a series of rungs disposed transversely between the corresponding uprights in rising formation. p Ladders are also known consisting of only one pair of uprights. For these, their working configuration inclined to the vertical is obtained by simply resting them against a wall, against a piece of furniture or against some other support. In all cases, when not in use, the minimum transverse dimension of known ladders (whether folding or simple) is at least equal to the distance between the two uprights, and this can constitute an unacceptable limitation for their transportation and storage, and in general during the periods in which they are not in use.

An object of the invention is to obviate the drawbacks of known ladders and to provide a folding ladder which occupies a limited space when not in use.

A further object of the invention is to provide a folding ladder which is stable and reliable during use.

A further object of the invention is to provide a folding ladder, the shape of which can be changed according to the requirements of the application.

These objects are attained according to the invention by a folding ladder comprising two pairs of uprights hinged at their top and a plurality of rungs connected to said uprights, characterised in that each rung is formed from two equal portions hinged together and is connected to the other rungs at said point of mutual hinging by a rod parallel to the uprights, and in that the rungs are hinged at their ends to said uprights for passing from the working configuration of the ladder in which they are orthogonal to the uprights, to the folded configuration of the ladder in which they are substantially parallel to the uprights.

BRIEF DESCRIPTION OF THE DRAWINGS

The present invention is further clarified hereinafter with reference to the accompanying drawings in which.

DETAILED DESCRIPTION

Figure 1:
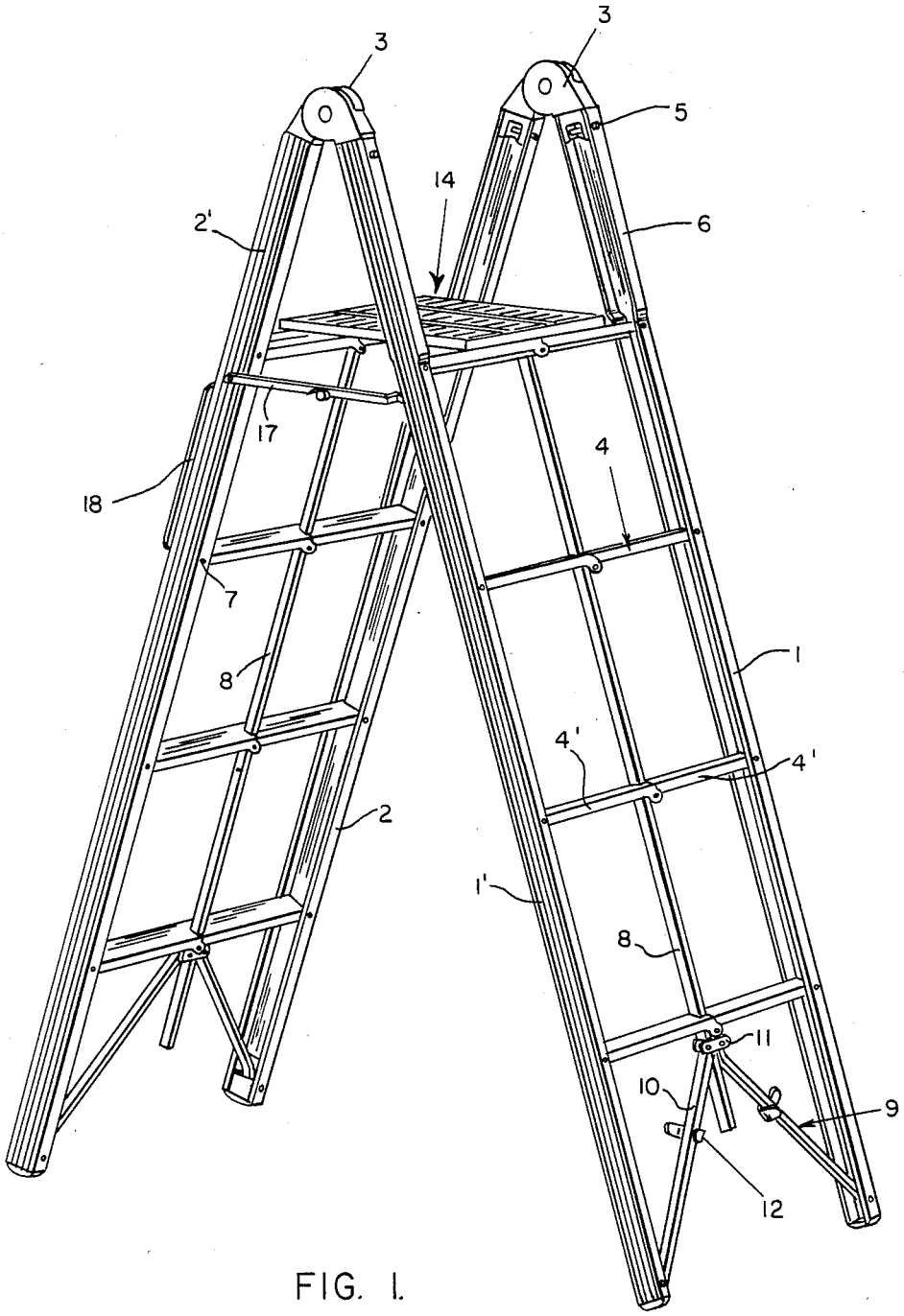
FIG. 1 shows the folding ladder according to the invention in its oppen configuration.

As can be seen from the figures, the folding ladder according to the invention comprises substantially two pairs of uprights 1,1' and 2,2' constructed of metal channel sections and hinged together at their top by means of pivotal joints 3, and a series of metal or rigid plastics rungs 4 interposed between the uprights 1,1' and 2,2'.

In particular, the pivotal joints 3 are permanently connected to the uprights 2,2', whereas they are connected to the uprights 1,1' in a removable manner by means of screws 5.

In addition, the upper portion 6 of the channel section of the uprights 1,1' is of substantially larger cross-section and corresponds to the outer cross-section (constant) of the channel section of the uprights 2,2'.

Each rung 4 is constituted by two equal portions 4' hinged together and to a central rod 8,8' respectively, which is equidistant from the respective pair of corresponding uprights. Furthermore, each rung 4 has its ends housed in the cavity defined by the channel cross-section of the uprights 1,1' and 2,2', and is hinged to these by pins 7.

In order to ensure that the rungs 4 are orthogonal to the uprights and that they are stable when the ladder is in its working configuration, each pair of uprights 1,1' and 2,2' is provided lowerly with a stop structure 9 constituted essentially by two inclined bars 10 hinged externally to the uprights and internally to a central block 11 in which the rod 8,8' slides freely.

Two hooks 12 facing thhe uprights 2,2' are fitted to the bars 12 of the pair of uprights 1,1' in order to ensure the stability of the folded configuration of the ladder as explained hereinafter.

A platform 14 is hinged to the upper end of the rod 8 by means of a small bar 13 and is formed in three foldable portions, the central portion 14' of the platform 14 being provided on its lower surface with a channel 15 for guiding the upper end of the rod 8' during the opening of the ladder.

Figure 2:
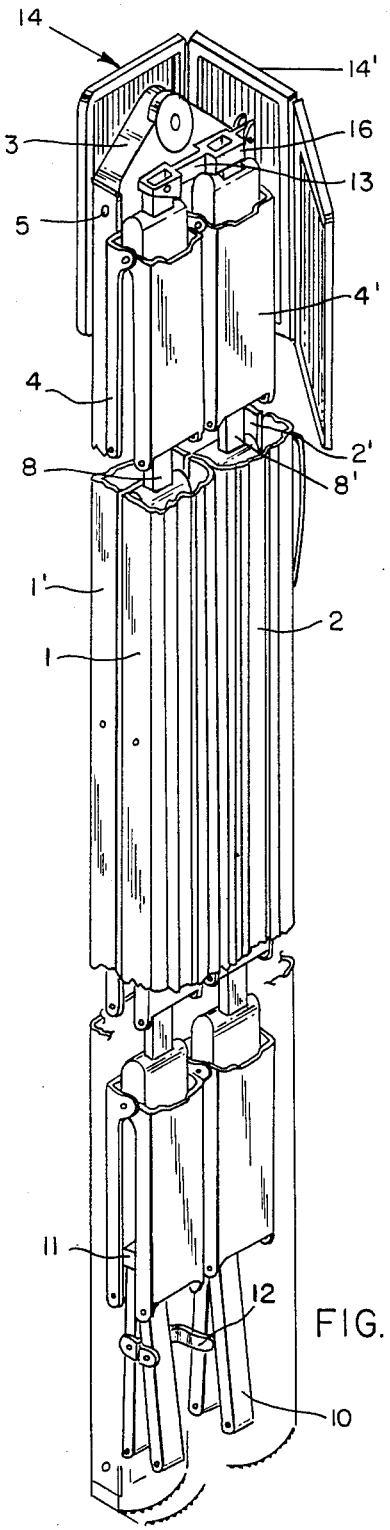
FIG. 2 is an interrupted enlarged perspective view thereof in its folded configuration.

The small bar 13 also comprises a slot portion 16 for engaging the uppper end of the rod 8' when the ladder is in its folded configuration (see FIG. 2).

In order to ensure the stability of the ladder when in its working configuration, the corresponding uprights 1, 2 and 1', 2' of the two pairs are connected together by two metal bars 17 hinged at their outer ends to the uprights and hinged together at their inner ends.

The operation of the ladder according to the invention is as follows: when in its working state (ladder open) the uprights 1,1' and 2,2' are disposed as an inverted V, open to an extent depending on the length and position of the bars 17. In this configuration the ladder is used as a conventional rung ladder, and each rung 4 is ensured of its horizontal position by the fact that the lowest rung rests on the block 11 of the structure 9.

The ladder is folded by the following procedure: after folding the bars 17 upwards, the uprights 2,2' are made to approach the uprights 1,1' until they mutually adhere. The slot portion 16 is then engaged with the now adjacent upper end of the rod 8', and the platform 14 turns by gravity about the pivot by which it is hinged to the small bar 13. The central rods 8,8' are then lifted, with the result that the rungs 4 fold up to assume an increasingly inclined wishbone configuration and at the same time cause the uprights 1,2 to approach the uprights 1', 2'.

When in the completely closed state, the uprights 1, 2 lie alongside the uprights 1', 2' and enclose within them the completely folded rungs 4 and the rods 8,8' which connect them together. After folding the two side portions of the platform 14, the ladder assumes the form of an easily storable longitudinal bar of rectangular or square cross-section. Moreover, because of the fact that the hooks 12 fitted to the bars 10 of the pair of uprights 1,1' now engage in the pair of uprights 2,2', the ladder is prevented from re-opening, and can be easily transported, preferably by virtue of the presence of suitable handles 18 on the uprights 2,2'.

If the ladder is to be used as a simple ladder, it is necessary only to release the uprights 1,1' from the uprights 2,2' by operating the screws 5 which fix these latter to the pivotal joints 3.

Figure 3:
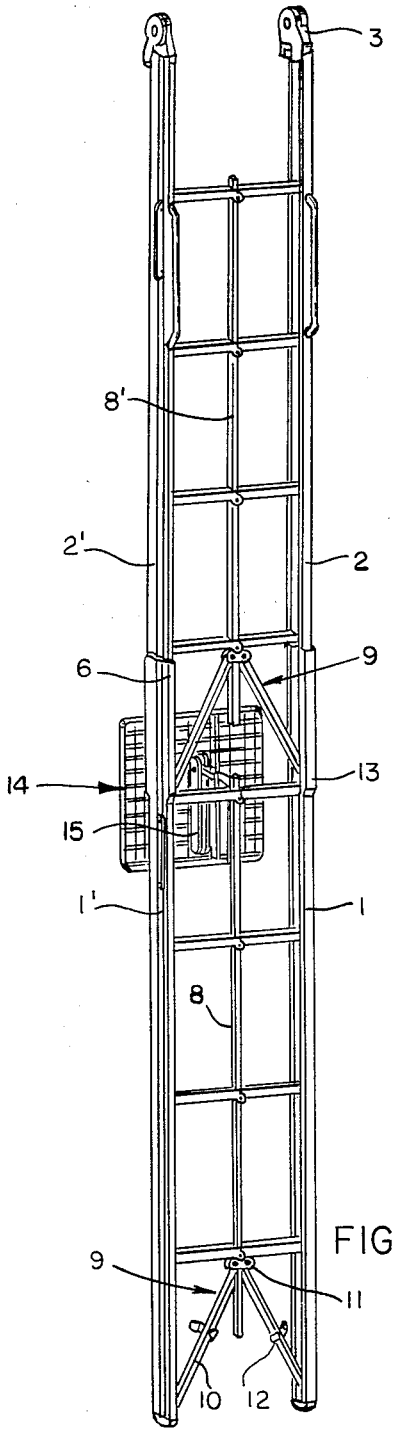
FIG. 3 shows it in a particular application as a simple ladder.

It is also possible to obtain a simple ladder of double height (see FIG. 3). This is done by releasing the uprights 1,1′ from the uprights 2,2′ as described heretofore, and then inserting the lower end of the uprights 2,2′ into the upper larger cross-section portion 6 of the uprights 1,1′.

From the aforegoing it is apparent that the folding ladder according to the invention offers numerous advantages, and in particular:

it can be easily transported, it can be stored, it can be used in different forms.

I claim:

1. A folding ladder comprising two pairs of uprights (1,1′, 2,2′) hinged at their top and a plurality of rungs (4) connected to said uprights, characterised in that each rung (4) is formed from two equal portions (4′) hinged together and is connected to the other rungs (4) at said point of mutual hinging by a rod (8,8′) parallel to the uprights, and in that the rungs (4) are hinged at their ends to said uprights for passing from the working configuration of the ladder in which they are orthogonal to the uprights, to the folded configuration of the ladder in which they are substantially parallel to the uprights, each pair of uprights being provided lowerly with a stop structure (9) constituted by two bars (10) hinged at their inner end to a block (11) in which the central rod (8,8′) slides, and hinged at their outer end to the upright (1,1′, 2,2′), said bars acting as struts on said block (11) when the ladder is in its working state.

2. A folding ladder comprising two pairs of uprights (1,1′, 2,2′) hinged at their top and a plurality of rungs (4) connected to said uprights, characterised in that each rung (4) is formed from two equal portions (4′) hinged together and is connected to the other rungs (4) at said point of mutual hinging by a rod (8,8′) parallel to the uprights, and in that the rungs (4) are hinged at their ends to said uprights for passing from the working configuration of the ladder in which they are orthogonal to the uprights, to the folded configuration of the ladder in which they are substantially parallel to the uprights, and a platform (14) constructed in three foldable portions, the central portion (14′) being hinged to the upper rung of one of the two pairs of uprights.

3. A ladder as claimed in claim 2, characterised in that the central portion (14′) of the platform (14) is connected to the upper rung of one of the two pairs of uprights by means of a small bar (13) provided with means for confining the corresponding uprights of the two pairs when in their position of mutual proximity.

4. A ladder as claimed in claim 3, characterised in that the small bar (13) is hinged to the upper end of one of the two rods (8,8′) and is provided with a slot portion (16) for engaging the upper end of the other rod when the corresponding uprights of the two pairs are in their position of mutual proximity.

* * * * *